US010808945B2

(12) United States Patent
Parvin et al.

(10) Patent No.: US 10,808,945 B2
(45) Date of Patent: Oct. 20, 2020

(54) ENERGY RECOVERY DEVICES, SYSTEMS, AND METHODS

(71) Applicant: Oy Halton Group Ltd., Helsinki (FI)

(72) Inventors: Fuoad A. Parvin, Hermitage, TN (US); Derek W. Schrock, Bowling Green, KY (US); Andrey V. Livchak, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 91 days.

(21) Appl. No.: 16/150,869

(22) Filed: Oct. 3, 2018

(65) Prior Publication Data

US 2019/0032926 A1 Jan. 31, 2019

Related U.S. Application Data

(63) Continuation of application No. 14/929,314, filed on Oct. 31, 2015, now Pat. No. 10,101,037, which is a continuation of application No. 13/696,360, filed as application No. PCT/US2011/035599 on May 6, 2011, now Pat. No. 9,194,592.

(60) Provisional application No. 61/359,212, filed on Jun. 28, 2010, provisional application No. 61/332,176, filed on May 6, 2010.

(51) Int. Cl.
*F24C 15/20* (2006.01)

(52) U.S. Cl.
CPC ..... *F24C 15/2042* (2013.01); *F24C 15/20* (2013.01); *F24C 15/2021* (2013.01); *F24C 15/2057* (2013.01)

(58) Field of Classification Search
CPC .. F24C 15/20; F24C 15/2021; F24C 15/2042; F24C 15/2057; B08B 15/023; F28C 3/06; F28D 21/0003; F28D 15/00; F28D 15/06; F28F 1/38; Y02B 30/52
See application file for complete search history.

(56) References Cited

U.S. PATENT DOCUMENTS

| | | | | |
|---|---|---|---|---|
| 4,143,645 | A | 3/1979 | Blumberg | |
| 4,825,848 | A | 5/1989 | Macias | |
| 6,347,527 | B1 * | 2/2002 | Bailey | F24F 3/001 165/45 |
| 6,895,954 | B2 * | 5/2005 | Swierczyna | F24C 15/2035 126/299 E |
| 7,069,838 | B2 | 7/2006 | Payen | |
| 2002/0189798 | A1 * | 12/2002 | Jacobs | F28D 21/0012 165/145 |
| 2006/0144226 | A1 | 7/2006 | Damrath et al. | |

(Continued)

FOREIGN PATENT DOCUMENTS

EP 0945685 A2 9/1999

OTHER PUBLICATIONS

International Search Report and Written Opinion for International Application No. PCT/US11/35599 dated Aug. 29, 2011.

*Primary Examiner* — Alfred Basichas
(74) *Attorney, Agent, or Firm* — Potomac Law Group, PLLC; George Dolina

(57) ABSTRACT

Energy recovery devices, systems and methods, and energy recovery control systems and methods for efficient extraction and reuse of waste heat from exhaust fumes generated from cooking appliances.

7 Claims, 8 Drawing Sheets

(56) References Cited

U.S. PATENT DOCUMENTS

| | | | |
|---|---|---|---|
| 2007/0068509 | A1 | 3/2007 | Bagwell et al. |
| 2009/0264060 | A1 | 10/2009 | Livchak et al. |

* cited by examiner

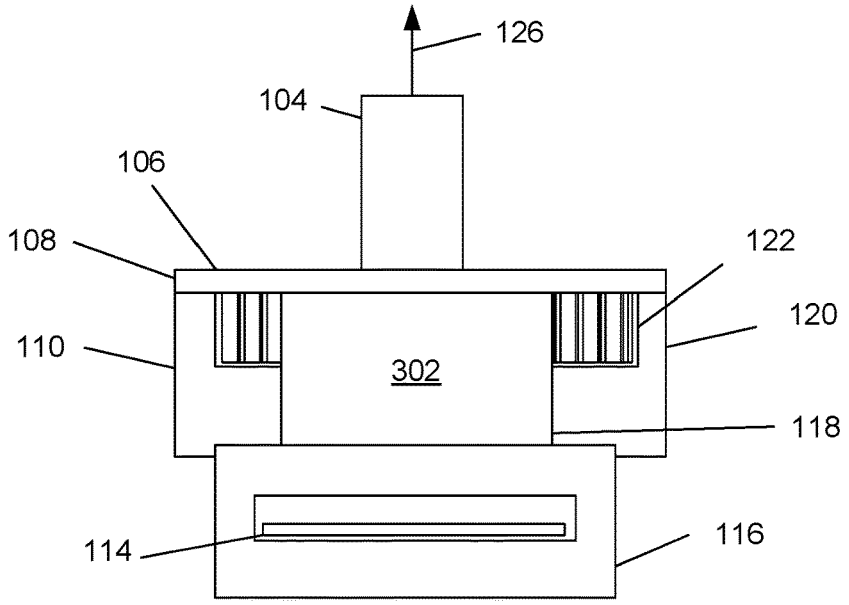
Fig. 3
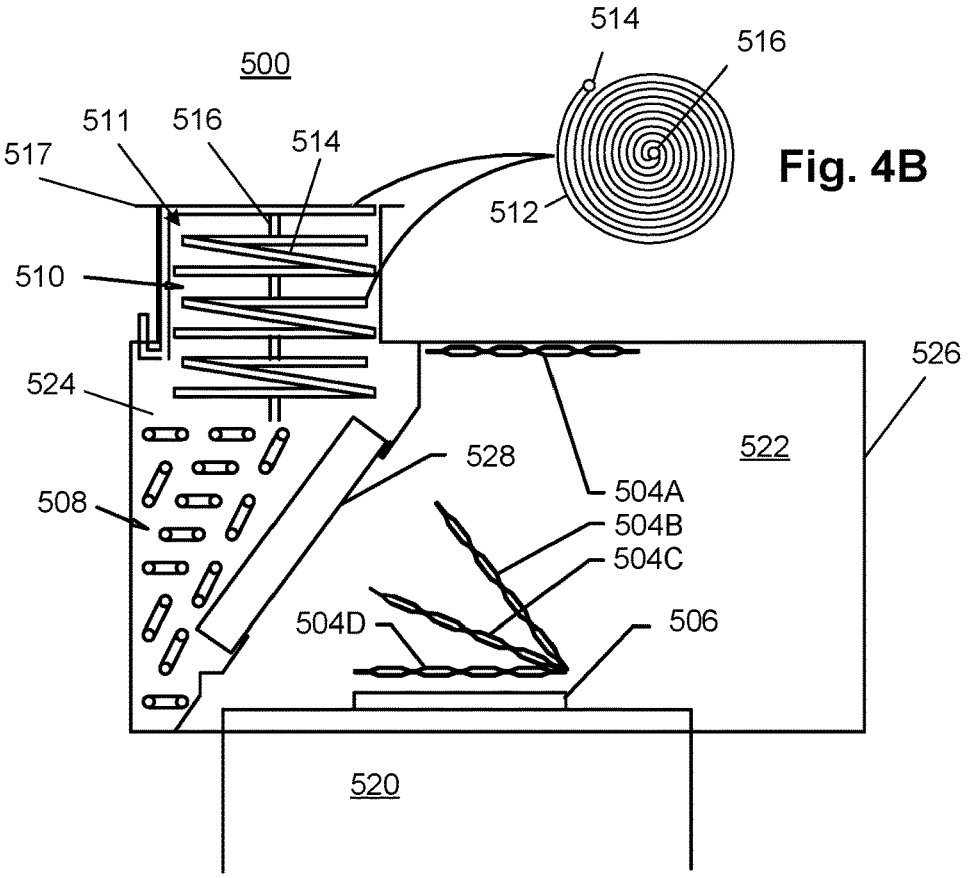
Fig. 4B
Fig. 4A

ENERGY RECOVERY DEVICES, SYSTEMS, AND METHODS

CROSS-REFERENCE TO RELATED APPLICATIONS

The present application is a continuation application of U.S. patent application Ser. No. 14/929,314, filed on Oct. 31, 2015; which is a Continuation Application of U.S. application Ser. No. 13/696,360 filed on Nov. 27, 2012 and which issued as U.S. Pat. No. 9,194,592 on Nov. 24, 2015; which claims priority to PCT Application No. PCT/US2011/035599 filed on May 6, 2011; which claims the benefit of priority of U.S. provisional applications 61/332,176, filed May 6, 2010, and 61/359,212, filed Jun. 28, 2010. The disclosures of each of the foregoing applications are hereby incorporated by reference.

RELATED FIELD

The present invention relates generally to energy recovery devices, systems and methods and more particularly to energy recovery devices and energy recovery control systems and methods for efficient extraction and use of waste heat.

BACKGROUND OF THE INVENTION

Restaurants in general generate large amounts of heat and grease-laden exhaust from the frying and broiling of various food items which are prepared. This grease-laden hot exhaust is typically drawn up through a kitchen hood and exhaust duct combination to the atmosphere by a fan arrangement. However, the heat is generally lost up the exhaust duct.

Any attempt to capture and reuse this waste heat runs into problems because energy recovery devices which use heat exchangers have either reduced heat-transfer properties due the grease that deposits on their surfaces, or because the heat extraction process employed to recover this heat is generally not very efficient.

SUMMARY OF THE INVENTION

Systems and methods are disclosed to efficiently extract and reuse heat from heat sources such as cooking appliances and heat from exhaust ducts and other locations in commercial kitchens, for example. Devices, systems and method for recovering energy normally lost by radiant and convective emission are described.

Energy recovery systems and method are disclosed to extract energy, in the form of heat, from various sources and employ the captured energy in various useful ways. Systems and methods are disclosed to efficiently control energy recovery from hot exhaust gases generated in exhaust systems.

Heat energy is recovered from a variety of sources and transferred to one or more consuming processes and/or converted to another usable form, such as electricity. The present systems are adapted for use in commercial kitchens, but can be used in other locations. Commercial kitchens may provide opportunities for usefully consuming waste energy. For example, hot water, low temperature heat can be used for hot water heating or pre-heating, food warming, absorbent-based air conditioning, dehumidification (e.g., desiccant regeneration) and other purposes. In addition, existing and new thermoelectric technologies permit thermal energy to be converted directly to electrical energy with reasonable efficiency.

The disclosed subject matter includes thermal energy recovery systems which may employ in various combinations, convective and radiant heat exchangers to recover heat from heat sources at respective temperatures; thermal storage, thermoelectric conversion devices, auxiliary heaters to boost fluid temperatures, valve final controllers, programmable controllers, and sensors.

According to embodiments, the disclosed subject matter includes a system for recovering heat from exhaust air generated from a cooking appliance having a combustion fumes outlet and a cooking fume outlet. The has an exhaust hood configured for use over a cooking appliance to receive cooking fumes therefrom, the hood having filters opens to a filter plenum which is connected to an exhaust duct. The filter plenum supports the filters on one side thereof and having an opens opposite a side of the plenum on which the filters are supported which opens, via a bypass opens, to a bypass plenum. The bypass plenum is configured with an inlet to allow connection to a combustion fume outlet of the cooking appliance. The bypass opening is defined by an adjustable member to allow the size of the bypass opens to be selected. There is at least on tube heat exchanger in at least one of the duct and the filter plenum and it is connectable to a liquid cooling loop. A bypass heat exchanger is disposed in a flow path of the bypass plenum and configured to circulate a heat-exchange fluid therethrough. A circulating pump circulates heat-exchange fluid through the tube heat exchanger and then through the bypass heat exchanger and through a further loop to a load or thermal storage device.

The tube heat exchanger may include a plurality of metal tubing portions in fluid communication with each other. The plurality of metal tubing portions may be position so that a majority thereof are spaced apart at least two tube diameters from each other to permit cleaning.

The at least one tube heat exchanger may be two heat exchangers, one occupying a substantial fraction of the filter plenum and another in the exhaust duct.

The system may include a panel type heat exchanger arranged to capture radiant and convective heat energy from the cooking appliance upstream of the filters. The panel type heat exchanger may be connected to receive heat transfer fluid from the at least one tube heat exchanger.

The at least one tube heat exchanger may include a stack of parallel disk-shaped spiral metal tubing portions connected in series, the disks is spaced at least three tube diameters apart, on centers.

The panel type heat exchanger may be movably coupled to the hood and have a selected position and orientation relative to the cooking appliance. The system may include a spraying device arranged within the filter plenum adapted to spray a contaminant-soluble cleaning solution onto the at least one tube heat exchanger.

The system may include a catalytic converter positioned to receive hot fumes from the cooking appliance. The hood may have a shroud that descends from the hood on three sides and extends down to the cooking appliance. The cooking appliance may be a conveyor-type (chain) automated grill. The pump may be a variable speed pump.

A controller may be connected to sensors or a communication channel to detect a state of the cooking appliance, wherein the state of the cooking appliance is one of an idle state and a cooking state.

The controller device may be further configured to modify the speed of the variable speed pump based on the detected state of the cooking appliance such that a minimum temperature of the heat transfer fluid conveyed through the at least one heat exchanger is maintained.

The controller device may be configured to continuously change a rate of heat recovery from the heat exchanger arrangement by modifying the speed of the variable speed pump based on a heat requirement of a load.

The load may include a water storage and supply reservoir, and wherein the controller device continuously changes the speed of the pump based on a need for hot water in the water storage and supply reservoir.

According to embodiments, the disclosed subject matter includes a heat recovery system for extracting and reusing heat from exhaust air generated from a plurality of cooking appliances, the heat recovery system. The system has a heat exchanger loop including a plurality of arrangements of metal tubing, each arrangement of metal tubing is disposed in a flow path of exhaust air generated from a corresponding cooking appliance, and each arrangement of metal tubing is configured to circulate a heat-exchange fluid therethrough. A circulating device is configured to circulate the heat-exchange fluid through the heat exchanger loop for heat transfer with said exhaust air, and configured to circulate the heat-exchange fluid between said heat exchanger loop and a location of heat utilization, wherein the plurality of arrangements of metal tubing are in fluid communication with each other. The cooking appliances may include at least one fryer.

The heat-exchange fluid and the exhaust air may move substantially perpendicular to one another through the heat exchanger loop. The circulating device may include a pumping device to circulate the heat-exchange fluid from a fluid source to the heat exchanger loop and from the heat exchanger loop to the location of heat utilization.

A controller device may control a rate at which heat is extracted from the heat exchanger loop. The controller device may control the heat recovery rate by controlling the flow rate of the heat-exchange fluid through the heat exchanger loop based on a heat requirement at the location of heat utilization. The pumping device may include a variable speed pump configured to change the speed and the flow rate of the heat-exchange fluid circulating through the heat exchanger loop, and wherein the controller device controls the flow rate of the heat-exchange fluid through the heat exchanger loop by changing the speed of the pump. The location of heat utilization may include a water storage and delivery system. The heat-exchange fluid may include water.

The heat extracted from the heat exchanger loop may be in the form of heated water. The circulating device may circulate the heated water from the heat exchanger loop to the water storage and supply device. The heat requirement at the location of the heat utilization may include a minimum temperature requirement at which the water in the water storage and supply device needs to be maintained. The system may have a plurality of detectors, each detector being associated with a respective arrangement of metal tubing, the detectors being configured to detect a temperature of the heat-exchange fluid exiting the corresponding arrangement of metal tubing. The controller device may control the rate of heat recovery based on the detected temperature of the heat-exchange fluid exiting each of the arrangements of metal tubing.

The controller device may control the rate of heat recovery by allowing the circulating device to only circulate the heat-exchange fluid having a predetermined temperature from the arrangements of metal tubing to the location of heat utilization.

According to embodiments, the disclosed subject matter includes a method for controlling heat recovery from exhaust air generated from a plurality of cooking appliances by transfer of heat from the exhaust air to a heat-exchange fluid circulating through a plurality of heat exchanger arrangements, each arrangement associated with a corresponding cooking appliance, the plurality of heat exchanger arrangements is in fluid communication with each other and is disposed in the flow path of the exhaust air, the method comprising: circulating the heat-exchange fluid through the plurality of heat exchanger arrangements and between the heat exchanger arrangements and a source of heat utilization, the source of heat utilization including a water storage device; detecting the temperature of the heat-exchange fluid outputted from each of the heat exchanger arrangements; detecting a temperature of the water in the water storage device; and comparing the temperatures of the heat-exchange fluid outputted from each of the heat exchanger arrangements and the temperature of the water in the water storage device, wherein only the heat-exchange fluid having a temperature higher than the temperature of the water in the water storage device is circulated to the water storage device.

Each of the heat exchanger arrangements may include a plurality of metal tubing arrangements disposed at different positions along the flow path of the exhaust air generated from a corresponding cooking appliance.

According to embodiments, the disclosed subject matter include an exhaust hood, comprising: a hood portion with a recess and an exhaust vent opens to the recess, the vent having a holder for cartridge filters; the hood portion having an outlet adapted to be connected to an exhaust duct for discharge of waste fumes; a plate-type thermoelectric conversion device positioned in the hood recess and oriented such that a major surface thereof faces downwardly toward a location where a cooking device would be located for use of the hood portion.

The plate-type thermoelectric conversion device may be incorporated in, positioned on, a movable sash that can be moved to a position that reduces the air flow aperture under the hood portion.

A controller may be configured to receive data indicating an operating state of the appliance and to automatically position the sash and output a signal indicating to reduce a rate of exhaust by an exhaust fan.

According to embodiments, the disclosed subject matter includes a system for recovering heat from exhaust air generated from a cooking appliance, comprising: an exhaust hood configured with at least one liquid cooled-heat exchanger arranged to capture heat from a cooker that emits fumes that are captured by the hood; at least one liquid cooled-heat exchanger is positioned and adapted for capturing heat by convection and/or radiation; an insulated tank selectively coupled to the at least one liquid cooled-heat exchanger by at least one control valve; a controller configured to determine an amount of thermal energy available from the at least one liquid cooled-heat exchanger and required by a heat-consuming load; the controller is further configured to flow a heat transfer fluid to one of a heat-consuming load and the insulated tank responsively to the amount of thermal energy available from the at least one liquid cooled-heat exchanger and required by a heat-consuming load and to add hot water from the thermal energy available from the at least one liquid cooled-heat exchanger and required by a heat-consuming load to the insulated tank when the heat available from the at least one liquid cooled-heat exchanger exceeds the amount required by the heat-consuming load.

An insulated tank may be selectively coupled to the at least one liquid cooled-heat exchanger by at least one control valve; a controller configured to determine an amount of thermal energy available from at least one of the heat exchangers and required by a heat-consuming load; the controller is further configured to flow a heat transfer fluid to one of a heat-consuming load and the insulated tank responsively to the amount of thermal energy available from the at least one of the heat exchangers and required by a heat-consuming load and to add hot water from the thermal energy available from the at least one liquid cooled-heat exchanger and required by a heat-consuming load to the insulated tank when the heat available from the at least one of the heat exchangers exceeds the amount required by the heat-consuming load.

According to embodiments, the disclosed subject matter includes an energy recovering system, comprising: an exhaust hood; a heat exchanger, of the type that receives and heats a heat transfer fluid, located in the hood to receive waste heat from exhaust products flowing through the exhaust hood; a thermal storage reservoir and filled with heat transfer fluid connected to the heat exchanger; a load supply outlet on the storage reservoir connected to a auxiliary heater, the heater is configured to raise the temperature of fluid drawn from the thermal storage reservoir to a level required by a heat-consuming load; a controller configured to operate the auxiliary heater and convey fluid to the load responsively to a load demand. The heat transfer fluid may be potable water.

BRIEF DESCRIPTION OF THE DRAWINGS

FIG. 3 shows the embodiment of FIG. 2 with an exhaust guide in place.

FIG. 4A shows an automatic grill with a plate heat exchanger for recovering radiant heat positioned at different angles relative to a broiler.

FIG. 4B shows a detail of a duct heat exchanger.

DETAILED DESCRIPTION

Figure 1:
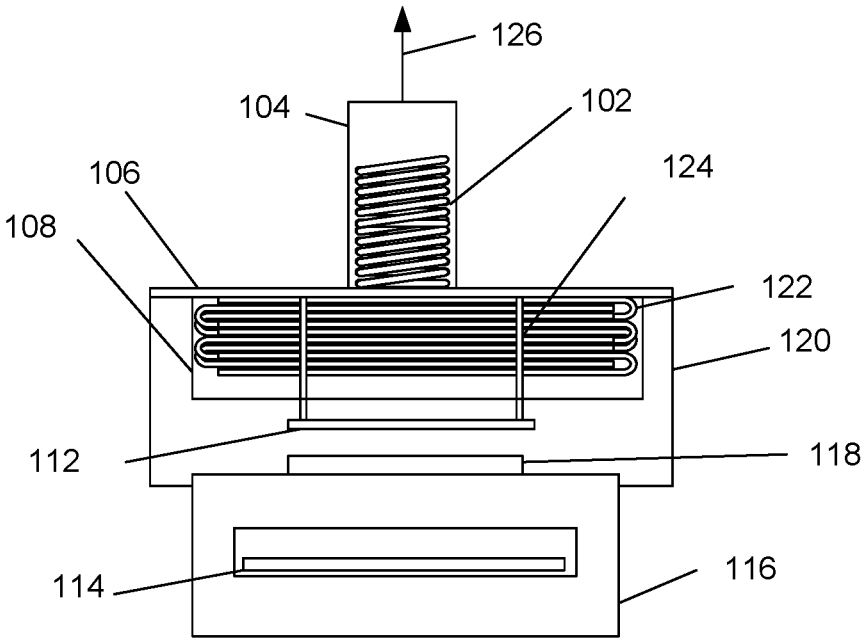
FIG. 1 shows an automatic grill with portions removed to show heat exchanger components.
Figure 2:
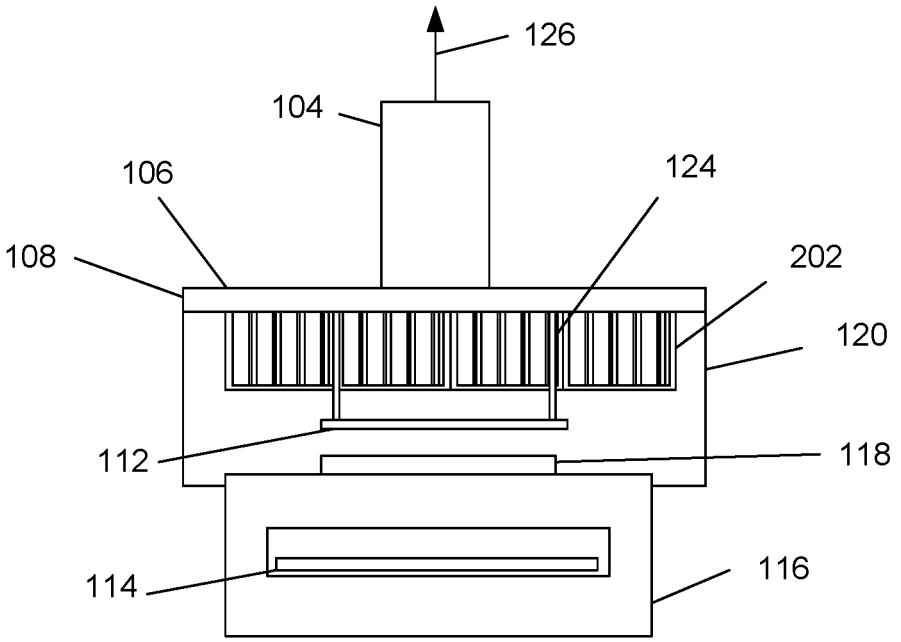
FIG. 2 shows the embodiment of FIG. 1 with exhaust parts in place.

FIGS. 1 to 3 show an energy or heat recovery device for a grill 116. The chain broiler 116 receives food onto a grill configured as a conveyor belt 114 that passes food over a source of heat, such as a gas burner or wood fire. Radiant and convective heat and flue products emanate from an exhaust opening 118 at the top of the grill 116.

Fumes from the exhaust opening 118 are captured by an exhaust hood 120. Fumes are drawn by an exhaust fan into a plenum 108 through grease filters 202 and removed through an exhaust duct 104 and a cooled product 126 ultimately discharged.

A flat heat exchanger panel 112 is arranged to capture radiant energy and, under certain conditions (if the temperature is lower than the exhaust products) convective heat, emanating through the exhaust opening 118. A bent tube heat exchanger 122 is located in the exhaust plenum 108 and captures heat convectively. The grease filters 202 serve to reduce the amount of fouling experienced by the heat exchanger 122. An additional tube type heat exchanger 102 is provided in a rising exhaust duct stemming from an exhaust collar of the hood 120.

The flat heat exchanger 112 has the potential to operate at a higher temperature than the tube heat exchanger 122 and the duct heat exchanger 102 due to the radiant energy capture from the heat source and the primary convective transfer from exhaust outlet 118 with minimal dilution by bypass air from the surrounding space which is drawn in by the hood 120. In an embodiment, the flat heat exchanger 112 supplies heat to a higher temperature load than the tube heat exchangers 102 and 122. In an alternative embodiment, a heat transfer fluid is circulated in a counterflow arrangement through the tube heat exchangers 112 and 122 and then through the flat heat exchanger 112.

The tube heat exchangers may be of continuous tubing, for example copper tubing, and positioned within in the exhaust flow path. The duct heat exchanger 102 may be a stack of spiral heat tubing winds interconnected in series at their perimeters and centers as in FIGS. 4A and 4B or a toroidal winding or any other suitable arrangement. Preferably the bare tubing is arranged to allow easy cleaning by a spray wash.

The flat heat exchanger panel 112 can be a single plate heat exchanger or a plate heat exchanger composed of multiple, thin, slightly separated plates, for example, that have large areas of fluid flow passage for heat transfer. The number and sizes of the plates can be varied.

The flat exchanger panel 112 may receive radiant energy from a hot catalytic converter which may be provided in the exhaust outlet 118. The catalytic converter achieves high temperatures for example in the area of 1200 F. As mentioned, the flat panel heat exchanger 112 also receives convective heat. In order to increase heat transfer and improve capture performance, the angle of inclination of the flat panel exchanger 112 relative to the cooking appliance (automatic grill, for example), as well as the vertical position of the plate relative of the grill can selected from a range of angles and position of the panel heat exchanger selected from a variety of locations, for example, as illustrated at 504A through 504D in the embodiment of FIG. 4.

A three-sided box structure functions as a flow guide 302 and is open at the back facing the filter cartridges 122. The flow guide 302 guides the exhaust air passing through the catalytic converter toward the plate heat exchanger 112 and from the plate heat exchanger toward the filter plenum 108. The flow guide 302, in an alternative embodiment, may be replaced with a wrap-around three-sided heat exchanger to scavenge further heat. Such a wrap-around heat exchanger may include a continuous spiraled metal tubing of copper, or each side can be a plate heat exchanger.

In embodiments, fumes rising in the collar may draw fumes by natural convection which may be sufficient that no powered exhaust is required. Generally powered exhaust will be used to create a negative pressure in the duct 102 and plenum 108.

The heat exchangers are designed and are positioned within the exhaust system to maximize a surface area of a tubing wall between the exhaust air moving through the tubing portion and the heat-exchange fluid circulating therein. To increase the surface area fins or corrugations may be added to channel fluid flow or induce turbulence and therefore increase the heat exchanger efficiency.

In embodiments all the heat exchangers may define a continuous flow path of a heat transfer or heat-exchange fluid.

In embodiments, more air is drawn through the filters than passes out of exhaust opening 118 such that fumes are prevented from escaping. The escape is further inhibited by the flow guide.

In embodiments where a water wash exhaust hood is positioned above the cooking appliance, the hood may include a spraying device arranged within the plenum of the exhaust hood and configured to spray a contaminant-soluble cleaning solution onto external surfaces of the heat exchanger "Crossflow HX" positioned within the plenum to remove the contaminant build-up therefrom.

In an embodiment, the flat heat exchanger 112 may be movable allowing it to be positioned to serve to prevent water wash fluid from entering the exhaust opening 118.

The heat recovery system may employ a powered circulating device (not shown), such as a variable speed pump, to circulate the heat transfer fluid through all of the heat exchangers in fluid communication with each other and to move the heat transfer fluid between the heat exchanger arrangement and a heat utilization location which is external to the heat recovery device and external to the exhaust hood. This location is where the recovered energy or heat in the form of hot or heated water is reused. The circulating device may further include pipes, tubes, valves, etc. to carry out the transfer from the heat exchanger arrangement to the external heat utilization location.

FIG. 4A shows an embodiment that is similar to the embodiment of FIGS. 1 to 3. Referring to FIG. 4, an energy or heat recovery device 500 for a chain broiler 520 uses a cross flow tubing type heat exchanger assembly including a first part 508 in the plenum space 524 and a second part 511 in an exhaust duct section 510.

Various alternative embodiments of a panel heat exchanger are indicated at 504A, 504B, 504C, and 504D. Embodiment 504B and 504C positions and orientations may help to further guide exhaust flow to the filter 528 and into the plenum 524. The panel exchanger may also be located more remotely such as at 504A but positioned inside an exhaust guide 526.

The first part of the tube type heat exchanger 508, in an embodiment and as illustrated, may consist of a series of lateral (going into the drawing page and perpendicular thereto) with 180 degree bends so the tubes traverse back and forth. The spacing between the tubes may be about twice their outer diameters (i.e., centers of adjacent tubes are three diameters apart) or more to allow for effective cleaning.

As shown in FIG. 4B as well as 4A, the tube heat exchanger second part 511 has a series of flat spiral disks 512 of tubing which are interconnected consecutively at their perimeters 514 and at their centers 516 to form a continuous heat transfer fluid flow path. The centerlines of the tubes may be spaced two or three diameters apart in the spiral winds. The tighter spacing in the spirals 512 may be compensated, for cleaning space purposes, by gaps between the parallel disks 512. Preferably both tube type heat exchangers are formed close to the walls of the respective plenum or duct to prevent short-circuit flow of air, so a spacing of no more than two diameters is preferred.

An exhaust collar 517 of the duct can be connected to an exhaust fan for extracting fumes from the hood. The plenum 524 has openings to accommodate filter cartridges 528. The plate heat exchanger 504A-504D receives radiant energy from a hot catalytic converter in the exhaust outlet 506.

In operation, exhaust air or exhaust fumes generated from the broiler flow through the catalytic converter and impinge the plate exchanger and are guided by the flow guide 526 toward the cartridge filters 528 (e.g. cleanable grease filters as used in restaurant hoods). The fumes flow through the filter cartridges 528 into the filter plenum 524 which houses the tube exchanger first part 508. The fumes then flow through duct section 510 and across the first tube heat exchanger second part 511 and are finally exhausted. The tube heat exchanger first part 508 and second part 511 may be serially interconnected in parallel, or completely separate to feed heat to different loads. IN a preferred embodiment, heat transfer fluid flows from the second part to the first part (511 to 508). The plate exchanger 504(A-D) may be connected to the second part to the first part (511, 508) or be connected to a separate load or thermal storage.

Note in all of the embodiments, above and below, the heat exchangers themselves, or a load, may include a thermoelectric converter to convert heat directly into electricity. Examples of thermoelectric devices include thermopiles or new technologies employing nano surfaces and multilayer semiconductor.

Figure 5:
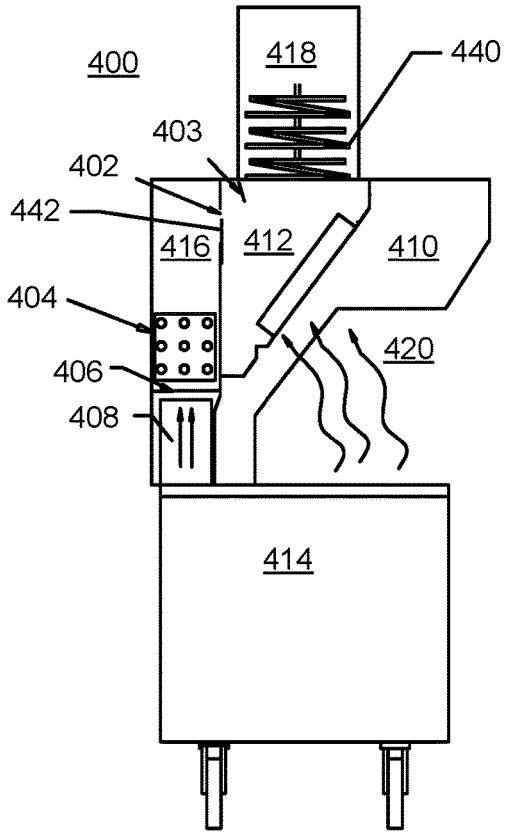
FIG. 5 shows a rear flue-bypass system with a crossflow heat exchanger.

FIG. 5 shows a heat recovery device 400 for a cooking appliance 414 such as a griddle or fryer. A hood 410 has a rear-flue-bypass 408 which receives combustion fumes from a fuel fired heating device in the cooking appliance 414 and conveys the combustion products into a bypass plenum 416 and then through an adjustable opening 402 into the exhaust plenum 412. Heat from the combustion fumes is recovered using a plate-fin cross flow tubing type heat exchanger 404 for convective heat transfer to a heat-exchange fluid circulating therethrough. The adjustable opening 402 is adjusted by a shutter plate 442 to allow ventilation of the fuel fired heater to be appropriate given the negative pressure in the plenum 412. A duct tube type heat exchanger 440—similar to exchanger 102 and 511 of embodiments 1-3 and 4A, 4B—may be used as well. Since combustion products may be hotter than fumes captured by the hood 410, in an embodiment, heat transfer fluid flows from exchanger 440 to exchanger 404 to provide a higher temperature output. A lip 403 (running perpendicular to the plane of the page) may be provided to prevent grease from dripping into the bypass plenum 416.

Figure 6:
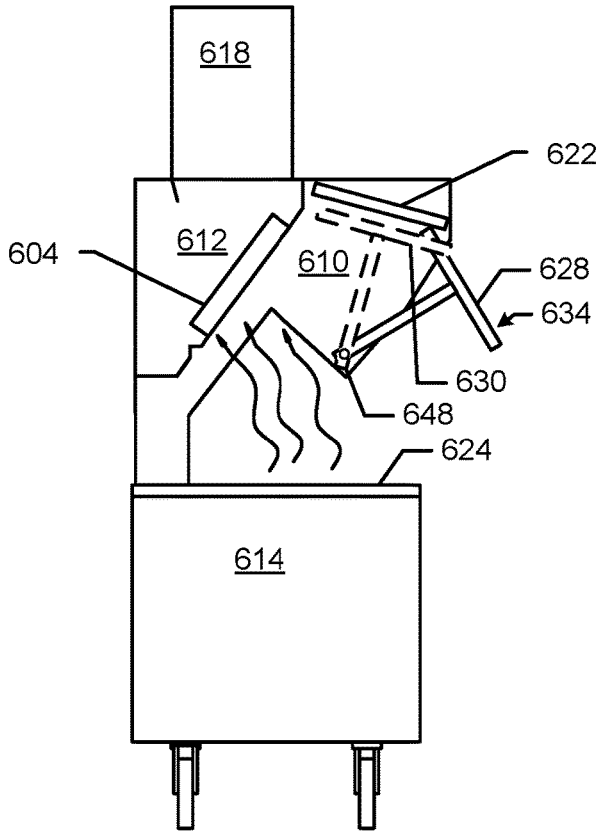
FIG. 6 shows a radiant heat recovery exchanger placed in a hood interior.

FIG. 6 shows an exhaust hood 610 with a filter plenum 612 and filter 604. An exhaust duct 618 is connected to an exhaust fan and draws fumes through the plenum 612 and the filters 604 from a cooker 614 with a hot surface 624 such as a griddle or fired grill. A flat panel heat exchanger 622 is fixedly supported as indicated at 622 to capture radiant heat from the hot surface 624.

In an alternative embodiment, a second flat panel exchanger 628 pivots from a home position 630 to a semi-shrouding position 634 to expand the area of radiant energy capture and to reduce the size of an aperture through which room air is drawn. A controller may position the heat exchanger 628 responsively to any of a variety of detected conditions such as occupancy (lack of occupancy) by a worker using an occupancy detector, time of day, operating condition of the cooker, video or infrared event recognition of a cooking phase. Techniques for such state or event detection are described elsewhere in the prior art so the details are not developed here. In the embodiment shown, the second flat panel exchanger 628 is closer to the hot surface 624 than the fixed one 622, however, it may be located in a more remote position and only activated when in the fenestrating position shown at 634. Any kind of mechanism may be used to make the panel 628 movable, including a pivot and arm as indicated at 648. The movable panel may be a thermoelectric panel to allow for fast response and avoid the need to provide plumbing.

Figure 7:
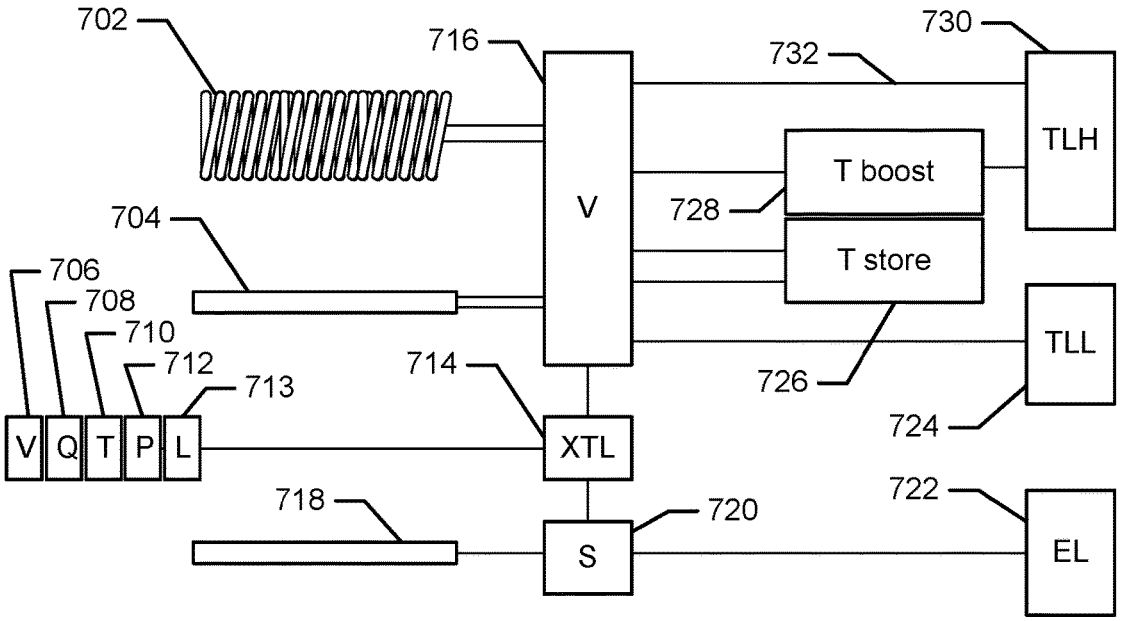
FIG. 7 shows an energy recovery system with control system and sensors.

FIG. 7 shows a control system 714, multi-way valve interconnect 716, tube heat exchangers 702, radiant plate heat exchangers 704, sensors for imaging 708, flow Q, temperature and/or radiant flux 710, production rate (which may be predicted or detected), quantitative load 713, direct heat to electrical receiver/converter 704, and auxiliary devices such as instantaneous fluid heater 728 to provide temperature boost, thermal storage 726, and high 730 and low 724 temperature thermal loads all interconnected to define a combined energy recovery system. Note that in embodiments, any of the above elements may be omitted. Also, the selected multi-way valve interconnect may be replaced by fixed connections as appropriate where no selectable and controllable changes in connections are required. Omitted from the general drawing are one or more pumps because these may be positioned in any of the interconnections shown as appropriate. Pumps may be controlled by the controller 714. Controller 714 is preferably a digital programmable controller with appropriate user interface and inputs and outputs for effecting commands and detecting conditions and events. The generalized system description applies to any and all embodiments disclosed herein modified accordingly.

In the foregoing embodiments, the heat exchangers may be in a continuous fluid communication with each other and connected in series with each other, namely, in such a way as to allow the heat transfer fluid to enter the heat exchanger arrangement through the first heat exchanger through all of the heat exchangers before exiting the heat exchanger arrangement through the last heat exchanger. A pumping mechanism may be employed to pump the heat transfer fluid from a fluid source to the heat exchanger arrangement, and to circulate the transfer fluid through the heat exchanger arrangement. The heat transfer fluid may be water or water with an antifouling agent. In operation, fluid is transferred from a source to the energy recovery heat exchanger arrangement and circulated to a load responsively to an event or operating condition. For example, when temperature of an exchanger itself reaches a threshold, pumping may begin and the rate of pumping may be responsive to the exchanger or the return fluid temperature to the load.

As fluid flows through the heat exchangers, it absorbs heat from the hot exhaust air, as a portion of the hot exhaust air is transferred to the copper tubing which in turn conducts its absorbed heat to the fluid circulating therein. Through this heat transfer, the fluid leaving the heat exchanger arrangement will be at a higher temperature than the fluid entering the heat exchanger arrangement, and at least a portion of the heat from the hot exhaust air is effectively recovered as hot fluid. The hot fluid leaving the heat exchanger arrangement can be used to supply hot fluid to different parts of the exhaust hood or different parts of the system, or it can be used to supply the restaurant with its hot fluid demand.

The efficiency of the heat recovery device is dependent not only on how much heat is extracted from the exhaust air and how much of it is absorbed by the fluid, but also how much energy is saved in the process.

In embodiments, the speed and flow rate of the fluid circulating through the heat exchanger arrangement so that the amount of fluid circulated is adjusted to fit a particular circumstance, need, or requirement.

Adjusting the speed and flow rate of the fluid in the heat exchanger arrangement can be done using a variable speed pump to circulate the fluid through the heat exchanger arrangement. Changing the speed of the variable speed pump changes the speed and the flow rate of the fluid circulating through the heat exchanger arrangement. A controller device can automatically adjust the speed of the pump based on various factors, including, but not limited to, the demand for hot fluid, the status of the cooking appliance, the temperature of the fluid leaving the heat exchanger arrangement, etc. The controller device is configured to receive a signal from a sensor indicating a need for hot fluid at the location of heat utilization P, for example, and based on the received signal the controller device can adjust the pump speed to circulate the fluid in the heat exchanger arrangement having a corresponding flow rate and speed. The controller device is further configured to receive a signal from the cooking appliance (not shown), the signal indicating whether the cooking appliance is idle or is being used (working), and based on the received signal the controller device can adjust the pump speed to circulate the corresponding amount of fluid through the heat exchanger arrangement.

The condition that there is abundance of heat that can be reclaimed which could significantly exceed demand may arise. Embodiments of any of the systems described herein may include an insulated storage tank sized for approximately the maximum predicted heat that can be reclaimed for a specified setpoint temperature. Such a tank may have a variable volume and may be filled to accommodate a corresponding amount of heat for consumption during times when heat demand exists but supply is not available or too low. For example, at an end of a work day and during off hours, the water level in the tank may be lowered by transferring heat from the tank and either storing in a cool source tank or draining. The cycle may be repeated for the next day or period, when the system is running. Such a structure provides a variable volume system with variable capacity.

In any of the disclosed systems, the load can include a heat loop used for warming/holding well or tables and cabinets, for example, a dry or steam well table.

Figure 8:
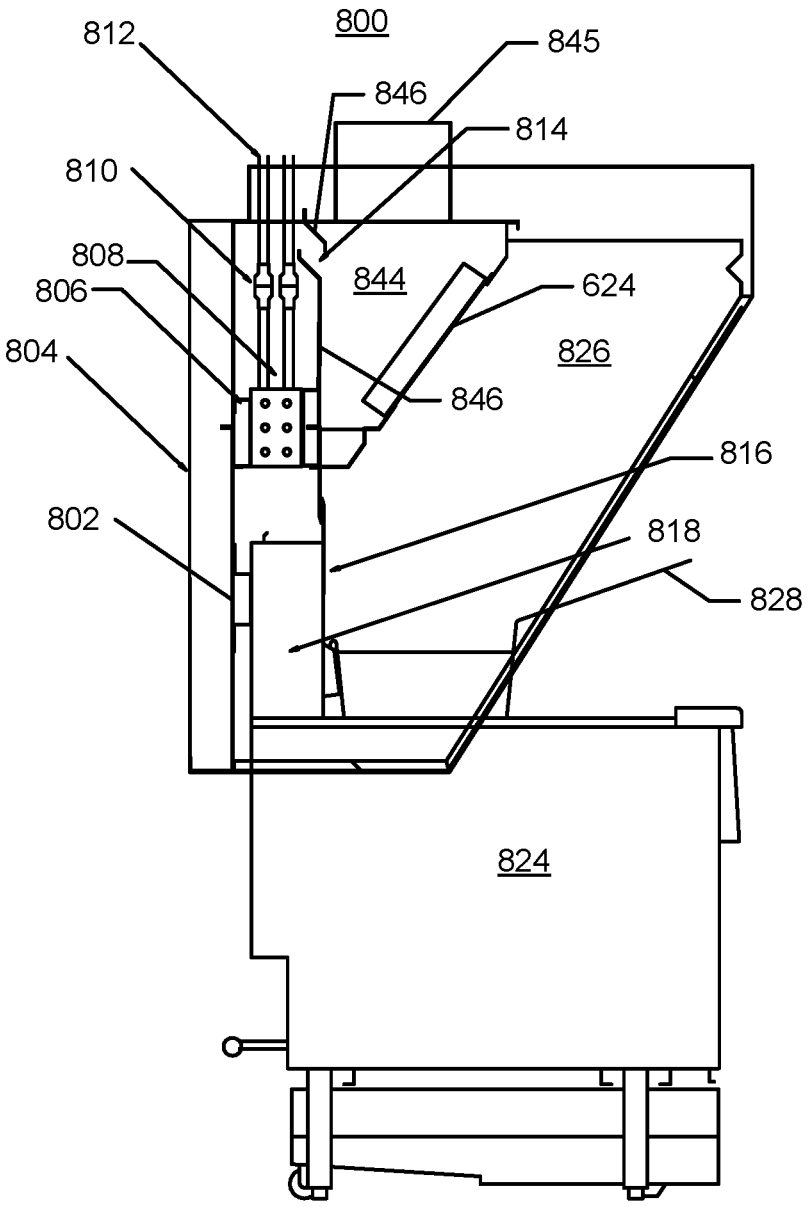
FIG. 8 shows a rear flue-bypass system with a crossflow heat exchanger according to another embodiment of the disclosed subject matter.

FIG. 8 shows another embodiment of a heat recovery device 800 for a cooking appliance 824 such as a griddle, fryer, oven, or other cooker (fryer basket shown at 828 so this embodiment is a fryer). A hood 826 has a rear-flue-bypass 818 which receives combustion fumes from a fuel fired heating device in the cooking appliance 824 and conveys the combustion products into a bypass plenum 808 and then through an adjustable opening 814 into a filter 624 bearing filter plenum 844. Heat from the combustion fumes is recovered using a plate-fin cross flow tubing type heat exchanger 806 for convective heat transfer to a heat-exchange fluid circulating therethrough. The adjustable opening 814 is adjusted by a shutter plate 846. The shutter plate 846 and a fixed plate 848 which collectively define the opening 814 have angled flanges to cause grease to drip away from the heat exchanger 806 and also to minimize wash water getting into the bypass plenum 808 from the filter plenum 844. The adjustable opening allows selection of the negative pressure in the bypass plenum to be regulated. A duct tube type heat exchanger—similar to exchanger 102 and 511 of embodiments 1-3 and 4A, 4B—may be provided as well. Couplings 810 may be provided for connecting the heat exchanger 806 to external fluid lines 812. A wall standoff is shown at 804 and a combustion outlet standoff at 802. The combustion outlet 818 supplies combustion gas to the bypass plenum 808. An exhaust take-off is indicated at 845.

Figure 9:
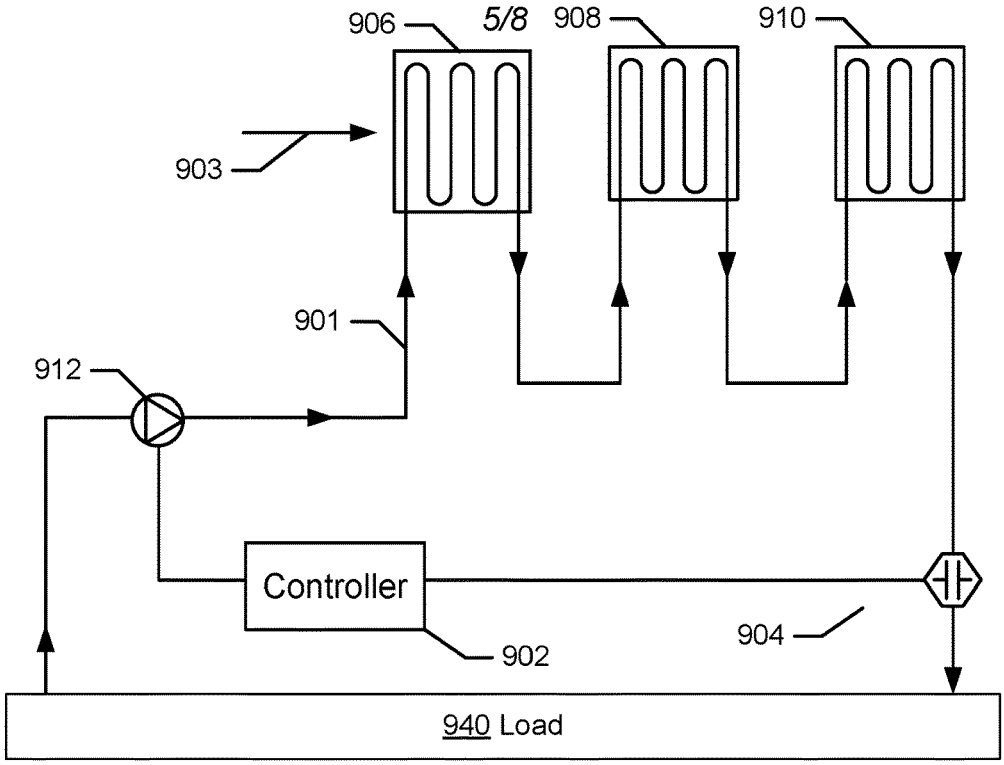
FIG. 9 shows a heat exchanger loop of an energy recovery device including three heat exchangers connected in series in a continuous fluid communication.

FIG. 9 illustrates another example of a heat transfer fluid flow in a heat exchanger loop of a heat recovery device. The heat recovery device can be any one of the heat recovery devices described in the embodiments. The heat exchangers are as shown at 906, 908, and 910. A circulation loop 901 circulates heat transfer fluid through the heat exchangers 906, 908, 901 in a series arrangement to recover thermal energy and convey heated heat transfer fluid to one or more loads 940. The controller 902 can control the pump 912 which may be a variable speed pump, responsively to a temperature 904.

Figure 10:
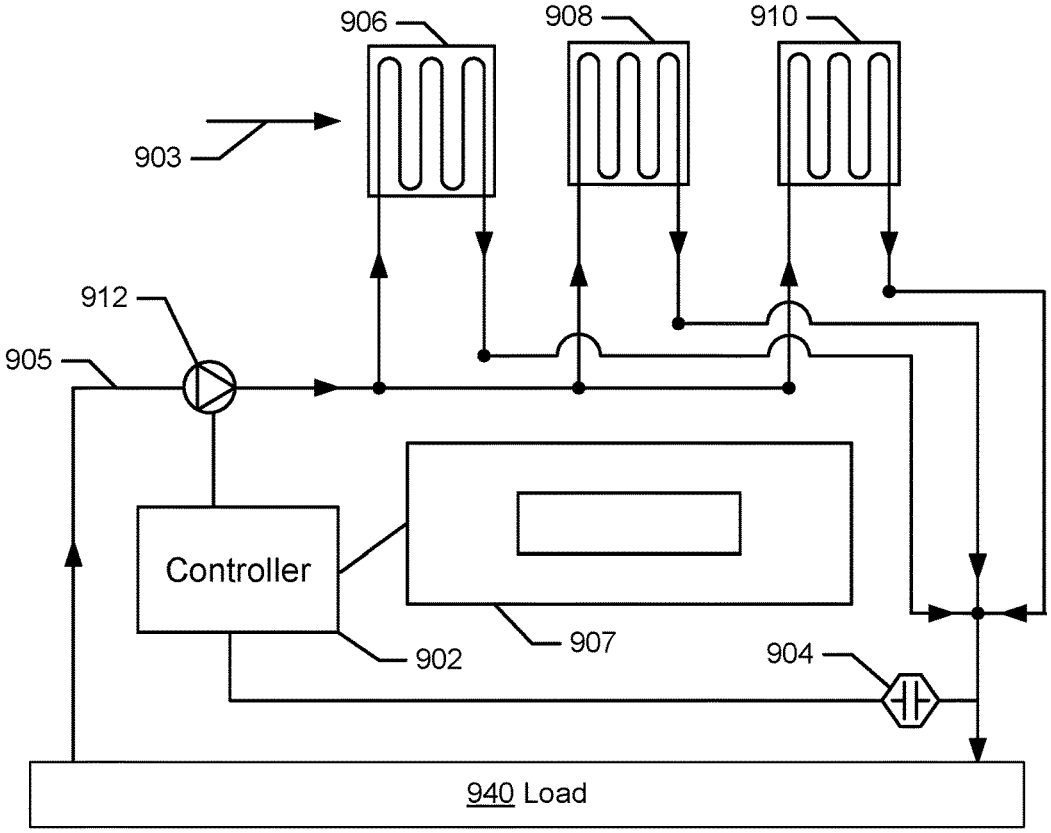
FIG. 10 shows a heat exchanger loop of an energy recovery device including at least three heat exchangers connected in parallel in fluid communication with each other.

FIG. 10 illustrates another example of a heat transfer fluid flow in a heat exchanger loop of a heat recovery device. The heat recovery device can be any one of the heat recovery devices described in the embodiments. The heat exchangers are as shown at 906, 908, and 910. A circulation loop 905 circulates heat transfer fluid through the heat exchangers 906, 908, 901 in a parallel arrangement to recover thermal energy and convey heated heat transfer fluid to one or more loads 940. The flows from the heat exchangers are combined at a junction for supply to one or more loads 940 or can be separately supplied to respective loads in an alternative embodiment. The controller 902 can control the pump 912 which may be a variable speed pump, responsively to a temperature 904. A respective pump may also be provided to the flow loops respective to each exchanger.

Figure 11:
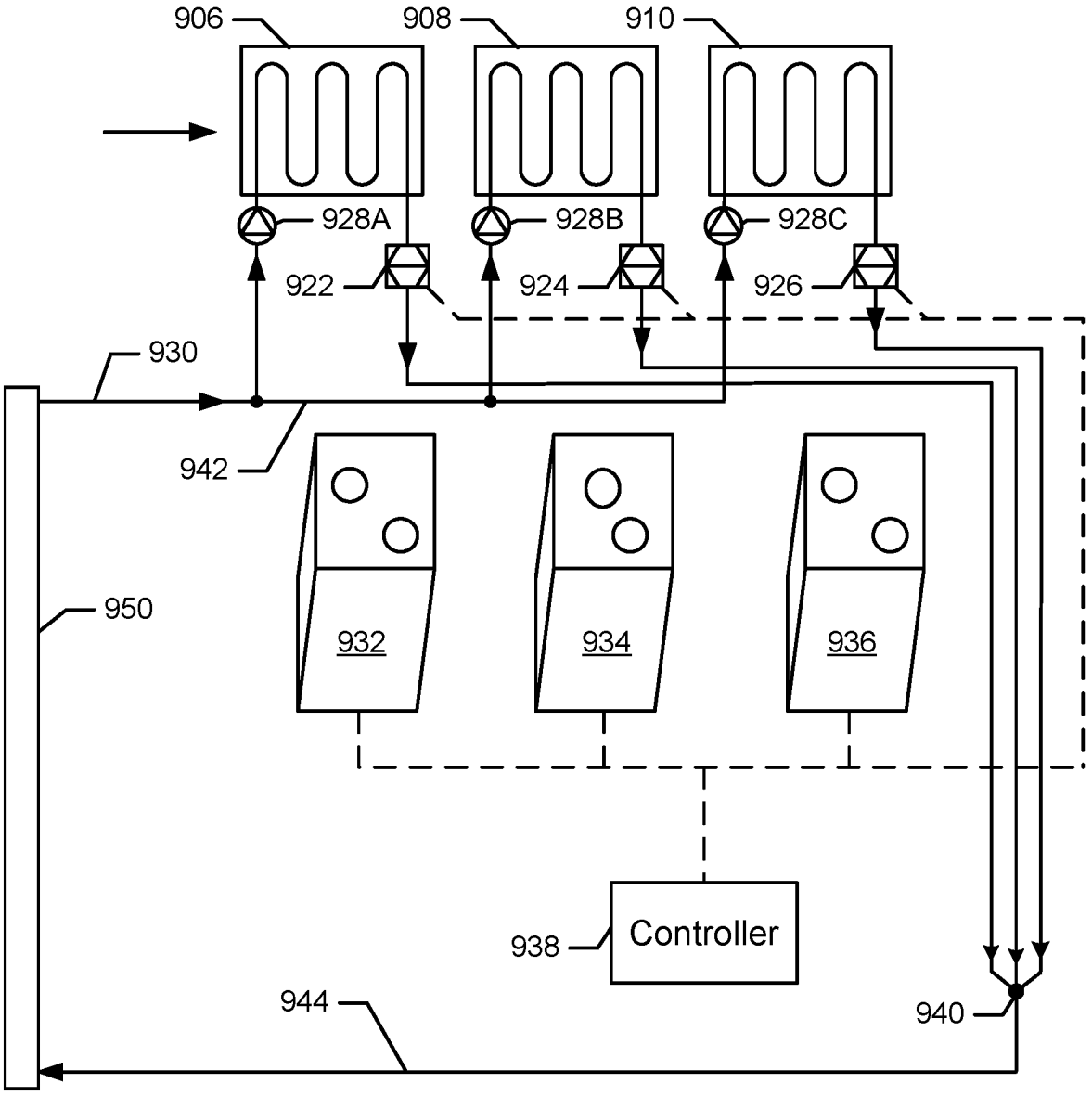
FIG. 11 shows a heat exchanger loop of an energy recovery device for heat recovery in a system with multiple hoods.

FIG. 11 shows the heat transfer fluid flow in a heat exchanger loop of a heat recovery device for a system that includes a plurality of exhaust hoods each with a corresponding cooking appliance 932, 934, 936. Only three cooking appliances and associated hoods are shown but more or fewer may be provided. The heat exchanger loop includes a plurality of heat exchanger sets 906, 908, 910, each set associated with a corresponding exhaust hood and/or cooking appliance. Each of the heat exchanger sets 906, 908, 910 may include one or plurality of heat exchangers, such as, but not limited to those described in the various embodiments such as embodiments of FIGS. 1-3. The plurality of heat exchanger sets 906, 908, 910 are in a fluid communication with each other so that a circulating device 928 can circulate heat transfer fluid simultaneously through all of the exchanger sets 906, 908, 910, and so that the heat transfer fluid can exit simultaneously from each of the heat exchanger sets. In the present arrangement the heat transfer fluid can be affected simultaneously in all heat exchanger sets 906, 908, 910. The circulating device may include a respective pump 928*a*, 928B, 928C, with each controlled responsively (e.g., negative feedback control) responsively to a respective sensor 922, 924, 926.

In operation, fluid is transferred from a heat transfer fluid source to the heat exchanger arrangement and circulated through each of the heat exchanger sets using the pumping mechanism. As the heat transfer fluid flows through the heat exchanger sets, it absorbs heat from the hot exhaust air through the metal tubing and it heats up. Through this heat transfer, the heat transfer fluid leaving the heat exchanger sets will be at a higher temperature than the heat transfer fluid entering the heat exchanger sets. Thus, at least a portion of the heat extracted from the hot exhaust air is effectively recovered as heated or hot heat transfer fluid. The hot heat transfer fluid leaving the heat exchanger arrangement can be used to supply hot heat transfer fluid to different parts of the exhaust hoods or different parts of the system or it can be used to supply the restaurant with its hot heat transfer fluid demand.

The speed and flow rate of the heat transfer fluid circulating through each of the heat exchanger sets 906, 908, 910, can be controlled so that the amount of heat transfer fluid circulated through each of heat exchanger set can be adjusted to fit a particular circumstance, need, or requirement. Adjusting the speed and flow rate of the heat transfer fluid in the heat exchanger sets can be done using variable speed pumps 928A, 928B, 928C. Changing the speeds of the variable speed pumps changes the speed and the flow rate of the heat transfer fluid circulating through each of the heat exchanger sets.

A controller device can automatically adjust the speed of each of the pumps 928A, 928B, 928C individually, based on various factors, such as, but not limited to, the demand for hot heat transfer fluid, the status of the cooking appliances, the temperature of the heat transfer fluid leaving each of the heat exchanger sets, etc. The controller device 938 is configured to receive a signal from sensors 922, 924, 926 indicating a need for hot heat transfer fluid at the location of load 950, for example, and based on that signal the controller can adjust each of the individual pump speeds to circulate the heat transfer fluid in the heat exchanger arrangement having a corresponding flow rate and speed.

Note that although a junction 940 is shown which combines the separate flow streams, each stream could convey fluid to a respective load. In one embodiment, high temperature heat exchangers may be connected in parallel and flow together through a junction to a high temperature load, medium temperature heat exchangers may be connected in parallel and flow together through a junction to a medium temperature load, and low temperature heat exchangers may be connected in parallel and flow together through a junction to a low temperature load. For example, the radiant heat exchanger may be the high temperature heat exchanger, the bypass heat exchanger, the medium temperature heat exchanger, and the flue or filter plenum heat exchanger may be the low temperature heat exchanger.

The controller device 938 may be further configured to receive signals from each of the cooking appliances 932, 934, 936, each signal indicating whether the corresponding appliance is in a particular working state such as idle, low power, or full power, for example. Based on the signals received the controller 938 may adjust the speed of each pump to circulate a corresponding amount of heat transfer fluid through respective heat exchanger sets or to shut down circulation.

The controller device is also configured to cut-off heat transfer fluid supply to any of the heat exchanger sets when the received signal indicates that the corresponding cooking appliance is in an idle state, thereby completely bypassing heat transfer fluid circulation through the heat exchanger set in the exhaust hood where the cooking appliance is not in use.

The controller device is further configured to receive signals from a temperature detecting system (not shown), the signals indicating the temperature of each of the heat exchanger sets. The controller device can completely shut-off heat transfer fluid circulation through any of the heat exchanger sets that has a temperature below a predetermined minimum temperature. The predetermined minimum temperature is indicative of whether a cooking appliance is in a working or in idle state. The controller device is further configured to reverse the flow of heat transfer fluid through the heat exchanger arrangement so that heat transfer fluid flows from a heat exchanger set having a lower temperature to a heat exchanger set having a higher temperature between those heat exchanger sets that have a temperature above the predetermined minimum temperature.

Figure 12:
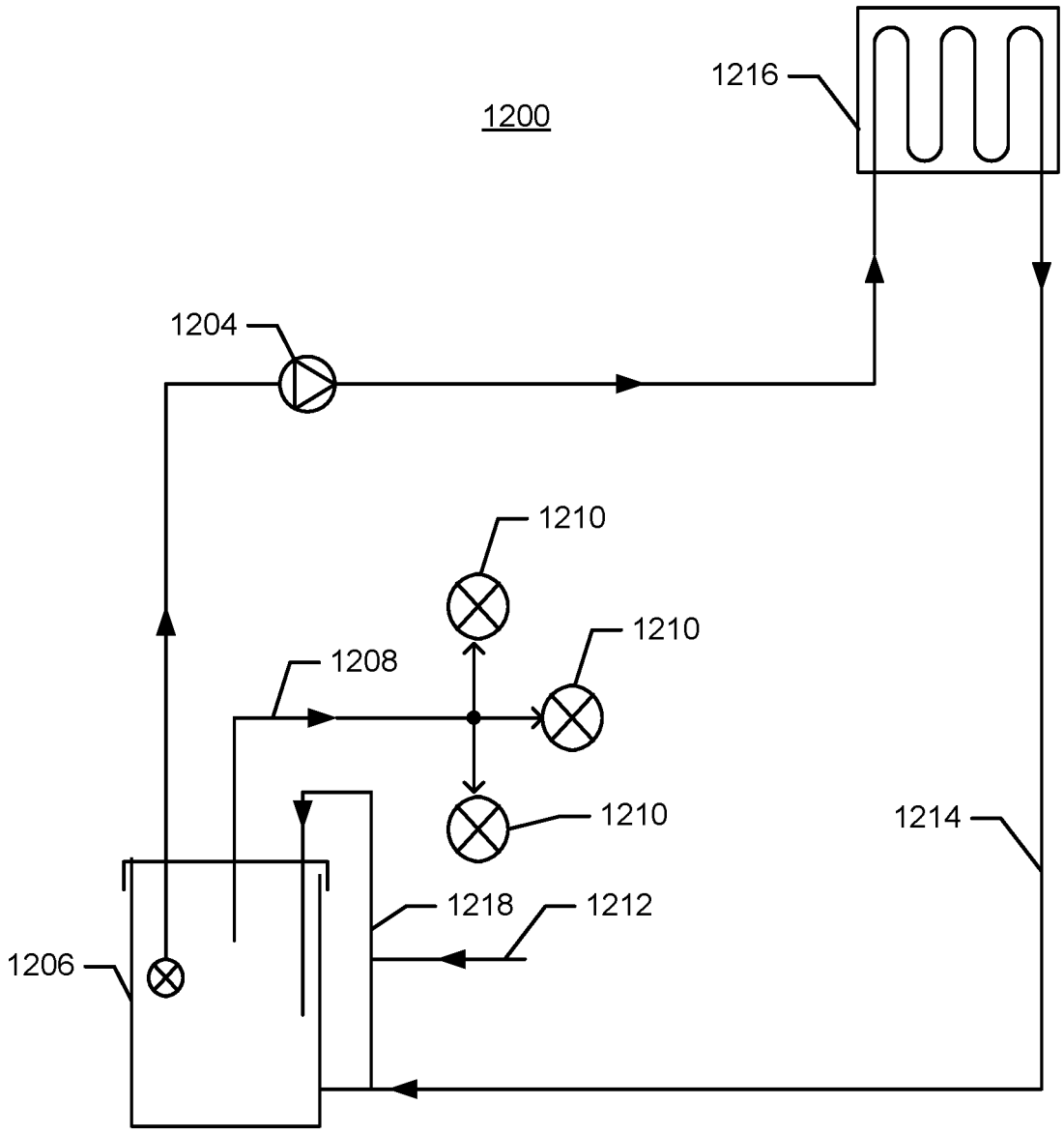
FIG. 12 shows a heat exchanger loop of an energy recovery device integrated with a water storage and supply reservoir.

FIG. 12 shows the heat transfer fluid flow in a heat exchanger loop of any one of the energy recovery devices discussed in detail in the arrangements shown in the various disclosed embodiments integrated with a hot water storage and supply system 1200. The heat exchanger loop 1214 can have one or more pumps 1204 and can include the heat exchanger 1216 arrangement of any of the embodiments in any combination where the system can include one or multiple exhaust hoods.

In operation, external water from an external water supply source (City Water Supply, for example) 1212 enters a water storage reservoir 1206 to fill an interior volume of the storage reservoir 1206. A valve (not shown) can be positioned between the entry point of the external water supply and the water storage reservoir. This valve can be closed at its entrance port to prevent more water being supplied to the water storage reservoir from the external water supply source and to prevent the interior volume being emptied in the direction of the external water supply source. Water from the water storage reservoir is transferred to the heat exchanger arrangement 1216 using a pump 1204. The water is circulated through the heat exchanger arrangement 1216 and heat from the hot exhaust air is transferred to the heat transfer fluid circulating therethrough. Hot heat transfer fluid is transferred back to the water storage reservoir and used to heat the water therein by means of a heat exchanger (not shown) or the heat transfer fluid may itself be the same as the water in the tank. The tank water may be gray water or potable. Hot water from the storage reservoir is then further transferred to different distributing points to supply hot water where hot water is needed. Preferably the tank is insulated. The hot water may be selectively consumed at various stations 1210 such as a dishwasher.

FIG. 10 shows the heat transfer fluid flow in a heat exchanger loop of any one of the energy recovery devices discussed in detail in the embodiment of FIG. 8 integrated with a hot water storage and supply system. The heat exchanger loop represents the heat exchanger arrangement of the system. Only three cooking appliances and associated hoods are shown. However, the system can include any number of hoods/cooking appliances. The heat-exchanger arrangement includes a plurality of heat exchanger sets HX1, HX2, HX3, each set associated with a corresponding exhaust hood and/or cooking appliance. Each of the heat exchanger sets HX1, HX2, HX3 includes a plurality of heat exchangers, such as, but not limited to, a "Panel HX", a "Crossflow HX", and a "Collar HX", positioned within their respective hoods as shown in the heat recovery device of the embodiment illustrated in FIGS. 1-3. The plurality of heat exchanger sets HX1, HX2, HX3, are in a fluid flow communication with each other and are connected in parallel so that a circulating device can circulate heat transfer fluid simultaneously through all of the exchanger sets HX1, HX2, HX3, and so that the heat transfer fluid can exit simultaneously from each of the heat exchanger sets.

The circulating device includes a pumping mechanism which moves water from a water source to the heat exchanger arrangement, and circulates the water through the heat exchanger sets. In operation, water is transferred from the water source to the heat exchanger arrangement and circulated through the heat exchanger sets using the pumping mechanism. As the water flows through the heat exchanger sets, it absorbs heat from the hot exhaust air and starts to heat up. Through this heat transfer, the water leaving the heat exchanger sets will be at a higher temperature than the water entering the heat exchanger arrangement, and at least a portion of the heat from the hot exhaust air is effectively recovered as hot water. The hot water leaving the heat exchanger arrangement can be used to supply hot water to different parts of the exhaust hoods or different parts of the system or it can be used to supply the restaurant with its hot water demand.

Figure 13:
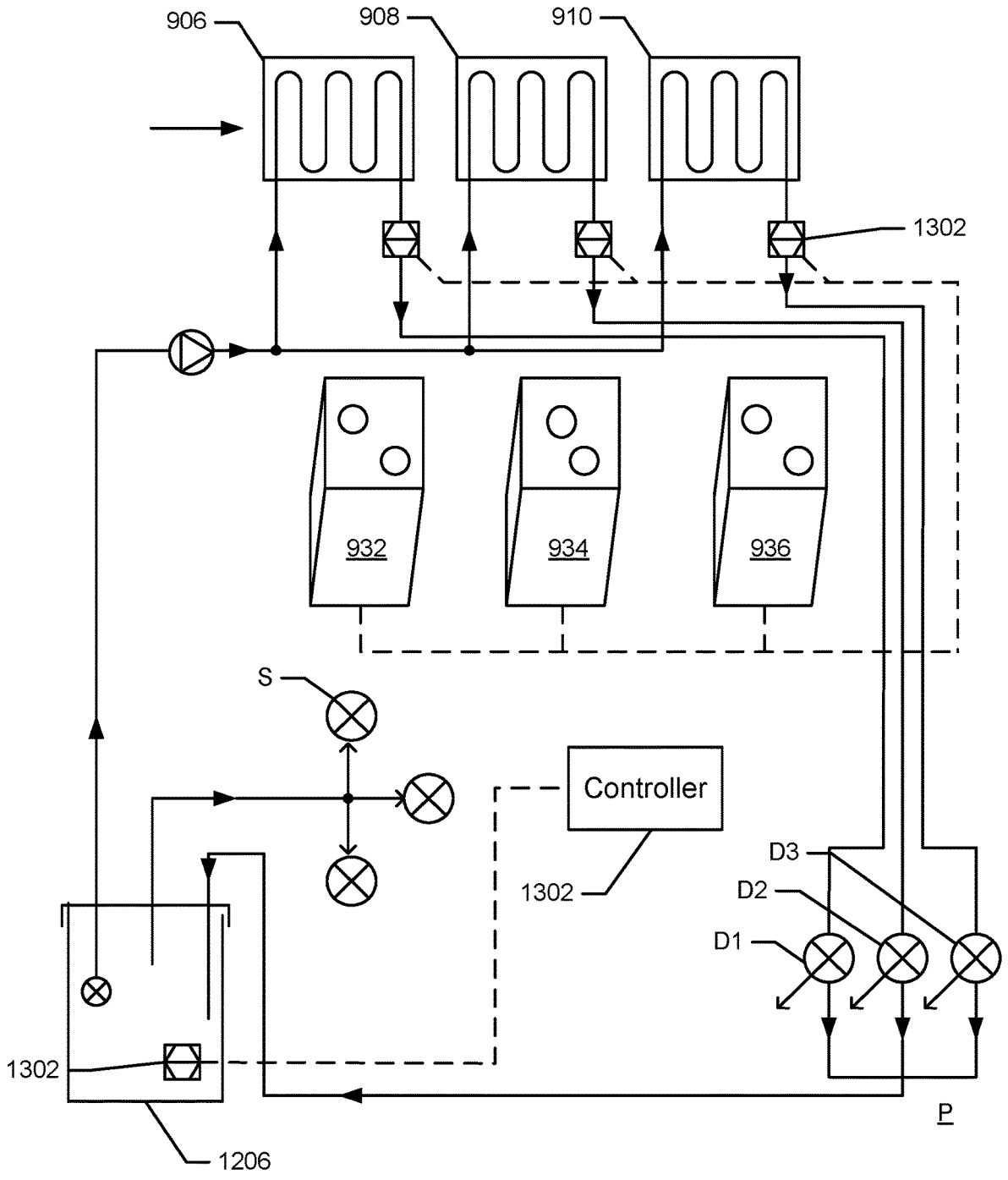
FIG. 13 shows a heat exchanger loop of an energy recovery device integrated with a water storage and supply reservoir including a controller device for controlling heat recovery.

FIG. 13 shows a system that combines features of the embodiments of FIG. 11 and FIG. 12. Here, a controller device 1302 receives information from respective cooking appliances 932, 934, 936 (which may be fewer or more in number) indicating whether the corresponding appliance is in an idle or a working state, and based on the signals received, the controller device can cut-off water circulation through any heat exchanger set associated with a cooking appliance in an idle state and thereby completely bypass water circulation through the heat exchanger set in the exhaust hood where the cooking appliance is not in use.

The controller device 1302 is further configured to receive signals from a temperature sensors 1302 (typ.), the signals indicating the temperature of the water leaving each of the heat exchanger sets 906, 908, 910. The controller device 1302 can further receive a signal from a temperature sensor 1302 in the hot water storage reservoir indicating the temperature of the water in the reservoir to regulate the pumping. For example, the controller device may be configured to compare the temperature of the water exiting each of the heat exchanger sets with the temperature of the water in the storage reservoir, and allow the circulating device including flow diverters to transfer water only from those heat exchanger sets for which the exiting water has a higher temperature than the temperature of the hot water storage reservoir. Thus exiting water having a higher temperature than the temperature of the water in the storage reservoir will be allowed to flow through diverters D1, D2, and D3 via pathways A to meet at a common point P from which the water is then circulated to the water storage reservoir. The water exiting the heat exchangers with temperatures below the temperature of the water in the storage reservoir will be diverted by the diverters D1, D2, and D3.

It is therefore, apparent that there is provided, in accordance with the present disclosure, an energy recovery device and method for recovering and reusing heat from hot exhaust air generated from cooking appliances, and a controller device and method for controlling the rate of the heat recovery. Many alternatives, modifications, and variations are enabled by the present disclosure. Features of the disclosed embodiments can be combined, rearranged, omitted, etc. within the scope of the invention to produce additional embodiments.

In particular, each of the described heat exchanger arrangements can further include additional heat exchangers present in the exhaust hood, such as, but not limited to, the three-sided wrap-around heat exchanger arrangement also used as the guiding device.

Furthermore, certain features of the disclosed embodiments may sometimes be used to advantage without a corresponding use of other features. Accordingly, Applicant intends to embrace all such alternatives, modifications, equivalents, and variations that are within the spirit and scope of the present disclosure.

What is claimed is:

1. An exhaust hood system for recovering heat from exhaust air generated from a cooking appliance, the system comprising:

a hood portion with a recess and an exhaust vent opening to the recess, the exhaust vent having a holder for cartridge filters;

the hood portion having an outlet adapted to be connected to an exhaust duct for discharge of waste fumes;

a bypass plenum having an inlet connection to a combustion fume outlet of the cooking appliance; and a heat exchanger positioned in the recess and configured to store heat from combustion fumes that pass through the bypass plenum.

2. The hood of claim 1, wherein the heat exchanger is incorporated in, positioned on, a movable sash that can be moved to a position that reduces an air flow aperture under the hood portion.

3. The hood of claim 2, further comprising a controller configured to receive data indicating an operating state of the cooking device and to automatically position the movable sash and output a signal indicating to reduce a rate of exhaust by an exhaust fan.

4. The system of claim 1, further comprising:

an insulated tank selectively coupled to the heat exchanger by at least one control valve;

a controller configured to determine an amount of thermal energy available from the heat exchanger and required by a heat-consuming load;

the controller being further configured to flow a heat transfer fluid to one of a heat-consuming load and the insulated tank responsively to the amount of thermal energy available from the heat exchanger and required by a heat-consuming load and to add hot water from the thermal energy available from the heat exchanger and required by a heat-consuming load to the insulated tank when the heat available from the heat exchanger exceeds the amount required by the heat-consuming load.

5. A method for controlling heat recovery from exhaust air generated from a plurality of cooking appliances by transfer of heat from the exhaust air to a heat-exchange fluid circulating through a plurality of heat exchanger arrangements, each arrangement associated with a corresponding cooking appliance, the plurality of heat exchanger arrangements being in fluid communication with each other and being disposed in a flow path of the exhaust air, the method comprising:

circulating the heat-exchange fluid through the plurality of heat exchanger arrangements and between the heat exchanger arrangements and a source of heat utilization, the source of heat utilization including a water storage device;

detecting a temperature of the heat-exchange fluid outputted from each of the heat exchanger arrangements;

detecting a temperature of water in the water storage device;

comparing the temperatures of the heat-exchange fluid outputted from each of the heat exchanger arrangements and the temperature of the water in the water storage device; and circulating only the heat-exchange fluid having a temperature higher than the temperature of the water in the water storage device to the water storage device.

6. The method of claim 5, wherein each of the heat exchanger arrangements includes a plurality of metal tubing arrangements disposed at different positions along the flow path of the exhaust air generated from a corresponding cooking appliance.

7. A system for recovering heat from exhaust air generated from a cooking appliance, comprising:

an exhaust hood configured with at least one liquid cooled-heat exchanger arranged to capture heat from a cooker that emits fumes that are captured by the exhaust hood;

the at least one liquid cooled-heat exchanger being positioned and adapted for capturing heat by convection and/or radiation;

an insulated tank selectively coupled to the at least one liquid cooled-heat exchanger by at least one control valve;

a controller configured to determine an amount of thermal energy available from the at least one liquid cooled-heat exchanger and required by a heat-consuming load;

the controller being further configured to flow a heat transfer fluid to one of a heat-consuming load and the insulated tank responsively to the amount of thermal energy available from the at least one liquid cooled-heat exchanger and required by a heat-consuming load and to add hot water from the thermal energy available from the at least one liquid cooled-heat exchanger and required by a heat-consuming load to the insulated tank when the heat available from the at least one liquid cooled-heat exchanger exceeds the amount required by the heat-consuming load.

* * * * *